US012024686B2

(12) United States Patent
Brennan et al.

(10) Patent No.: US 12,024,686 B2
(45) Date of Patent: Jul. 2, 2024

(54) GASOLINE ADDITIVE COMPOSITION FOR IMPROVED ENGINE PERFORMANCE

(71) Applicant: Afton Chemical Corporation, Richmond, VA (US)

(72) Inventors: Tim Brennan, Chesterfield, VA (US); Julienne Galante-Fox, Midlothian, VA (US); Janice Jianzhao Wang, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/936,987

(22) Filed: Sep. 30, 2022

(65) Prior Publication Data

US 2024/0132792 A1 Apr. 25, 2024

(51) Int. Cl.

| | |
|---|---|
| ***C10L 1/224*** | (2006.01) |
| ***C10L 1/185*** | (2006.01) |
| ***C10L 1/232*** | (2006.01) |
| ***C10L 10/18*** | (2006.01) |

(52) U.S. Cl.

CPC ..... *C10L 1/224* (2013.01); *C10L 1/1852* (2013.01); *C10L 1/232* (2013.01); *C10L 10/18* (2013.01); *C10L 2200/0423* (2013.01); *C10L 2230/22* (2013.01); *C10L 2270/023* (2013.01)

(58) Field of Classification Search

CPC ..... C10L 1/224; C10L 1/1852; C10L 1/232; C10L 10/18; C10L 2200/0423; C10L 2230/22; C10L 2270/023

See application file for complete search history.

(56) References Cited

U.S. PATENT DOCUMENTS

| | | | |
|---|---|---|---|
| 2,129,264 | A | 9/1938 | Baxter et al. |
| 2,425,755 | A | 8/1947 | Roberts et al. |
| 2,425,845 | A | 8/1947 | Toussaint et al. |
| 2,448,664 | A | 9/1948 | Fife et al. |
| 2,457,139 | A | 12/1948 | Fife et al. |
| 2,475,755 | A | 7/1949 | Pearson |
| 2,568,876 | A | 9/1951 | White et al. |
| 2,886,423 | A | 5/1959 | Kozikowski |
| 3,015,668 | A | 1/1962 | Kozikowski |
| 3,027,246 | A | 3/1962 | Bartlett |
| 3,092,474 | A | 6/1963 | Ebner |
| 3,172,892 | A | 3/1965 | Le Suer et al. |
| 3,198,613 | A | 8/1965 | Udelhofen |

(Continued)

FOREIGN PATENT DOCUMENTS

| | | |
|---|---|---|
| CA | 2089833 A1 | 8/1993 |
| CN | 1256302 A | 6/2000 |

(Continued)

OTHER PUBLICATIONS

Smith, S. Scott et al. Measurement and Control of Fuel Injector Deposits in Direct Injection Gasoline Vehicles. SAE International; Oct. 14, 2013. doi:10.4271/2013-01-2616.

(Continued)

*Primary Examiner* — Vishal V Vasisth
(74) *Attorney, Agent, or Firm* — Honigman LLP

(57) ABSTRACT

The present disclosure provides fuel additives including quaternary ammonium salt additive(s) and Mannich detergent additive(s) effective to improve engine performance in both port fuel injected and gasoline direct injection engines.

15 Claims, 2 Drawing Sheets

(56) References Cited

U.S. PATENT DOCUMENTS

| | | | |
|---|---|---|---|
| 3,202,678 | A | 8/1965 | Stuart et al. |
| 3,216,936 | A | 11/1965 | Le Suer et al. |
| 3,219,666 | A | 11/1965 | Norman et al. |
| 3,254,025 | A | 5/1966 | Le Suer |
| 3,272,746 | A | 9/1966 | Le Suer et al. |
| 3,361,673 | A | 1/1968 | Le Suer et al. |
| 3,468,640 | A | 9/1969 | Barusch et al. |
| 3,676,089 | A | 7/1972 | Morris et al. |
| 3,778,371 | A | 12/1973 | Malec |
| 4,038,043 | A | 7/1977 | Garth |
| 4,056,531 | A | 11/1977 | Malec |
| 4,067,698 | A | 1/1978 | Steckel |
| 4,152,499 | A | 5/1979 | Boerzel et al. |
| 4,171,959 | A | 10/1979 | Vartanian |
| 4,231,759 | A | 11/1980 | Udelhofen et al. |
| 4,234,435 | A | 11/1980 | Meinhardt et al. |
| 4,248,719 | A | 2/1981 | Chafetz et al. |
| 4,253,980 | A | 3/1981 | Hammond et al. |
| 4,326,973 | A | 4/1982 | Hammond et al. |
| 4,338,206 | A | 7/1982 | Hammond et al. |
| 4,482,357 | A | 11/1984 | Hanlon |
| 4,605,808 | A | 8/1986 | Samson et al. |
| 4,613,341 | A | 9/1986 | Zaweski et al. |
| 4,729,769 | A | 3/1988 | Schlicht et al. |
| 4,787,916 | A | 11/1988 | Feldman |
| 4,844,714 | A | 7/1989 | Vogel et al. |
| 4,877,416 | A | 10/1989 | Campbell et al. |
| 5,024,677 | A | 6/1991 | Wang |
| 5,250,174 | A | 10/1993 | Hart |
| 5,254,138 | A | 10/1993 | Kurek |
| 5,330,667 | A | 7/1994 | Tiffany, III |
| 5,393,309 | A | 2/1995 | Cherpeck |
| 5,514,190 | A | 5/1996 | Cunningham et al. |
| 5,518,511 | A | 5/1996 | Russel et al. |
| 5,575,823 | A | 11/1996 | Wallace et al. |
| 5,620,486 | A | 4/1997 | Cherpeck |
| 5,634,951 | A | 6/1997 | Colucci et al. |
| 5,697,988 | A | 12/1997 | Malfer et al. |
| 5,725,612 | A | 3/1998 | Malfer et al. |
| 5,752,989 | A | 5/1998 | Henly et al. |
| 5,756,428 | A | 5/1998 | Emert et al. |
| 5,800,103 | A | 9/1998 | Stadtfeld et al. |
| 5,814,111 | A | 9/1998 | Graham et al. |
| 5,873,917 | A | 2/1999 | Daly |
| 5,876,468 | A | 3/1999 | Moreton |
| 6,048,373 | A | 4/2000 | Malfer et al. |
| 6,166,238 | A | 12/2000 | Filipkowski |
| 6,405,711 | B1 | 6/2002 | Smith et al. |
| 6,458,172 | B1 | 10/2002 | Macduff et al. |
| 6,462,014 | B1 | 10/2002 | Johnson |
| 6,475,250 | B2 | 11/2002 | Krull et al. |
| 6,548,458 | B2 | 4/2003 | Loper |
| 6,695,890 | B1 | 2/2004 | Hazel et al. |
| 6,730,773 | B2 | 5/2004 | Heinen |
| 6,800,103 | B2 | 10/2004 | Malfer et al. |
| 6,867,171 | B2 | 3/2005 | Harrison et al. |
| 7,297,675 | B2 | 11/2007 | Alef |
| 7,402,185 | B2 | 7/2008 | Aradi et al. |
| 7,435,272 | B2 | 10/2008 | Aradi et al. |
| 7,704,289 | B2 | 4/2010 | Alters et al. |
| 7,744,660 | B2 | 6/2010 | Burrington et al. |
| 7,766,982 | B2 | 8/2010 | Colucci et al. |
| 7,906,470 | B2 | 3/2011 | Stevenson et al. |
| 7,947,093 | B2 | 5/2011 | Barton et al. |
| 7,951,211 | B2 | 5/2011 | Barton et al. |
| 8,097,570 | B2 | 1/2012 | Boitout et al. |
| 8,231,695 | B2 | 7/2012 | Cunningham et al. |
| 8,425,627 | B2 | 4/2013 | Dietz et al. |
| 8,449,630 | B2 | 5/2013 | Lange et al. |
| 8,475,541 | B2 | 7/2013 | Fang et al. |
| 8,486,876 | B2 | 7/2013 | Brewer et al. |
| 8,496,716 | B2 | 7/2013 | Lange et al. |
| 8,557,003 | B2 | 10/2013 | Malfer et al. |
| 8,778,034 | B2 | 7/2014 | Cunningham |
| 8,863,700 | B2 | 10/2014 | Fang et al. |
| 8,894,726 | B2 | 11/2014 | Fang et al. |
| 8,961,623 | B2 | 2/2015 | Stevenson et al. |
| 8,974,551 | B1 | 3/2015 | Fang et al. |
| 9,062,265 | B2 | 6/2015 | Reid et al. |
| 9,340,742 | B1 | 5/2016 | Fang et al. |
| 2003/0014910 | A1 | 1/2003 | Aradi et al. |
| 2003/0131527 | A1 | 7/2003 | Colucci et al. |
| 2004/0029766 | A1 | 2/2004 | Frick et al. |
| 2004/0060226 | A1 | 4/2004 | Bongart et al. |
| 2004/0167040 | A1 | 8/2004 | Dahlmann et al. |
| 2005/0066572 | A1 | 3/2005 | Colucci et al. |
| 2005/0120619 | A1 | 6/2005 | Koch |
| 2005/0215411 | A1 | 9/2005 | Mackney et al. |
| 2006/0070293 | A1 | 4/2006 | Lange et al. |
| 2006/0168876 | A1 | 8/2006 | Colucci et al. |
| 2006/0196110 | A1 | 9/2006 | Schwahn et al. |
| 2006/0196111 | A1 | 9/2006 | Colucci et al. |
| 2006/0272597 | A1 | 12/2006 | Burrington et al. |
| 2007/0015681 | A1 | 1/2007 | Allef et al. |
| 2007/0193119 | A1 | 8/2007 | Schwab |
| 2007/0245621 | A1 | 10/2007 | Malfter et al. |
| 2008/0086936 | A1 | 4/2008 | Cunningham et al. |
| 2008/0113890 | A1 | 5/2008 | Moreton et al. |
| 2008/0307698 | A1 | 12/2008 | Barton et al. |
| 2009/0049740 | A1 | 2/2009 | Hurst |
| 2009/0071065 | A1 | 3/2009 | Malfer et al. |
| 2009/0235576 | A1 | 9/2009 | Volkel et al. |
| 2009/0282731 | A1 | 11/2009 | Malfer et al. |
| 2010/0005706 | A1 | 1/2010 | Burgazli et al. |
| 2010/0024289 | A1 | 2/2010 | Smith |
| 2010/0037513 | A1 | 2/2010 | Petrucci et al. |
| 2010/0037514 | A1 | 2/2010 | Malfter et al. |
| 2010/0132253 | A1 | 6/2010 | Kaufman et al. |
| 2010/0151396 | A1 | 6/2010 | Papachristos et al. |
| 2010/0236510 | A1 | 9/2010 | Shea et al. |
| 2011/0162263 | A1 | 7/2011 | Vilardo et al. |
| 2011/0185626 | A1 | 8/2011 | Barton et al. |
| 2011/0237469 | A1 | 9/2011 | Khandekar et al. |
| 2011/0258917 | A1 | 10/2011 | Garcia et al. |
| 2011/0302828 | A1 | 12/2011 | Fang et al. |
| 2011/0308550 | A1 | 12/2011 | Reid |
| 2011/0315107 | A1 | 12/2011 | Grabarse et al. |
| 2012/0010112 | A1 | 1/2012 | Grabarse et al. |
| 2012/0291339 | A1 | 11/2012 | Martin et al. |
| 2013/0031827 | A1 | 2/2013 | Reid et al. |
| 2013/0031828 | A1 | 2/2013 | Reid et al. |
| 2013/0104826 | A1 | 5/2013 | Burgess et al. |
| 2013/0220255 | A1 | 8/2013 | Fang |
| 2013/0233267 | A1 | 9/2013 | Barbour |
| 2013/0237466 | A1 | 9/2013 | Lange et al. |
| 2013/0247450 | A1 | 9/2013 | Wolf |
| 2013/0255139 | A1 | 10/2013 | Dolmazon et al. |
| 2013/0296210 | A1 | 11/2013 | Hansch et al. |
| 2013/0298948 | A1 | 11/2013 | Company et al. |
| 2013/0312318 | A1 | 11/2013 | Peretolchin et al. |
| 2013/0227878 | A1 | 12/2013 | Wolf et al. |
| 2013/0324665 | A1 | 12/2013 | Shaikh et al. |
| 2013/0333650 | A1 | 12/2013 | Fang et al. |
| 2014/0157655 | A1 | 6/2014 | Tort et al. |
| 2014/0174390 | A1 | 6/2014 | Reid et al. |
| 2014/0196678 | A1 | 7/2014 | Fang et al. |
| 2015/0033617 | A1 | 2/2015 | Arondel et al. |
| 2015/0252277 | A1 | 9/2015 | Hansch et al. |
| 2016/0272912 | A1 | 9/2016 | Voelkel et al. |
| 2016/0289584 | A1 | 10/2016 | Russo et al. |
| 2020/0024536 | A1 | 1/2020 | Shanahan et al. |

FOREIGN PATENT DOCUMENTS

| | | | |
|---|---|---|---|
| CN | 101671584 | B | 5/2013 |
| EP | 0016312 | A1 | 10/1980 |
| EP | 0293192 | A1 | 11/1988 |
| EP | 1293553 | A2 | 3/2003 |
| EP | 1411105 | A2 | 4/2004 |
| EP | 1518918 | A1 | 3/2005 |
| EP | 1918355 | A1 | 5/2008 |
| EP | 2033945 | A1 | 3/2009 |
| EP | 2674471 | A1 | 12/2013 |
| EP | 2987845 | A1 | 2/2016 |

(56) References Cited

FOREIGN PATENT DOCUMENTS

| | | | | |
|---|---|---|---|---|
| EP | 3597726 | A1 * | 1/2020 | ..... C10L 1/023 |
| GB | 842728 | A1 | 7/1960 | |
| GB | 2493377 | A | 2/2013 | |
| WO | 2004050806 | A2 | 6/2004 | |
| WO | 2005023965 | A1 | 3/2005 | |
| WO | 2010132209 | A1 | 11/2010 | |
| WO | 2013000738 | A2 | 1/2013 | |
| WO | 2013017889 | A1 | 2/2013 | |
| WO | 2013070503 | A1 | 5/2013 | |
| WO | 2013092533 | A1 | 6/2013 | |
| WO | 2015011505 | A1 | 1/2015 | |
| WO | 2017168312 | A1 | 10/2017 | |
| WO | 2019079246 | A1 | 4/2019 | |

OTHER PUBLICATIONS

The extended European Search Report issued in Application No. 23195748.1 dated Jan. 29, 2024, 7 pages.

* cited by examiner

GASOLINE ADDITIVE COMPOSITION FOR IMPROVED ENGINE PERFORMANCE

TECHNICAL FIELD

This disclosure is directed to fuel additives for spark-ignition engines providing enhanced engine and/or injector performance, to fuel compositions including such additives, and to methods for using such fuel additives in a fuel composition.

BACKGROUND

Fuel compositions for vehicles are continually being improved to enhance various properties of the fuels in order to accommodate their use in newer, more advanced engines including both gasoline port fuel injected engines as well as gasoline direct injected engines. Often, improvements in fuel compositions center around improved fuel additives and other components used in the fuel. For example, friction modifiers may be added to fuel to reduce friction and wear in the fuel delivery systems of an engine. Other additives may be included to reduce the corrosion potential of the fuel or to improve the conductivity properties. Still other additives may be blended with the fuel to improve fuel economy. Engine and fuel delivery system deposits represent another concern with modern combustion engines, and therefore other fuel additives often include various deposit control additives to control and/or mitigate engine deposit problems. Thus, fuel compositions typically include a complex mixture of additives.

However, there remain challenges when attempting to balance such a complex assortment of additives. For example, some of the conventional fuel additives may be beneficial for one characteristic or one type of engine, but at the same time be detrimental to another characteristic of the fuel. In some instances, fuel additives effective in gasoline port fuel injection engines do not necessarily provide comparable performance in gasoline direct injection engines and vice versa. In yet other circumstances, fuel additives often require an unreasonably high treat rate to achieve desired effects, which tends to place undesirable limits on the available amounts of other additives in the fuel composition. Yet other fuel additives tend to be expensive and/or difficult to manufacture or incorporate in fuels. Such shortcomings are particularly true in the context of quaternary ammonium salt fuel additives that are often difficult or costly to manufacture and/or require relatively high treat rates for performance.

SUMMARY

In one aspect, a method of providing improved engine performance is provided herein. In one embodiment or approach, a fuel additive package for a spark-ignition engine is described herein to provide the improved engine performance and includes (i) a Mannich detergent including the reaction product of a hydrocarbyl-substituted phenol, one or more aldehydes, and one or more amines and (ii) a quaternary ammonium internal salt obtained from amines or polyamines that is substantially devoid of any free anion species.

In other approaches or embodiments, the fuel additive package described above may include one or more optional features or embodiments in any combination. These optional features or embodiments may include one or more of the following: wherein the fuel additive package further includes an alkoxylated alcohol; and/or wherein a weight ratio of the alkoxylated alcohol to the Mannich detergent is about 0.8 or less; and/or wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof; and/or wherein a weight ratio of the Mannich detergent to the quaternary ammonium internal salt is about 5:1 to about 100:1; and/or wherein the Mannich detergent has the structure of Formula I:

(Formula I)

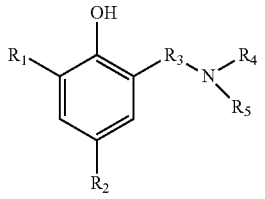

wherein $R_1$ is hydrogen or a C1 to C4 alkyl group, $R_2$ is a hydrocarbyl group having a number average molecular weight of about 500 to about 3000, $R_3$ is a C1 to C4 alkylene or alkenyl group, and $R_4$ and $R_5$ are, independently, hydrogen, a C1 to C12 alkyl group, or a C1 to C4 alkyl amino C1-C12 alkyl group; and/or wherein the quaternary ammonium internal salt has the structure of Formula II (Formula II)

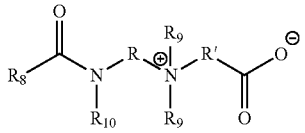

wherein R and R' are, independently, alkylene linkers having 1 to 10 carbon atoms; $R_8$ is a C12 to C100 alkylene, alkene, or hydrocarbyl group or an aryl group or optionally substituted aryl group; each $R_9$ is, independently, a linear or branched C1 to C4 alkyl group; and $R_{10}$ is a hydrogen atom or a C1 to C4 alkyl group; and/or wherein the alkoxylated alcohol is a polyether having the structure of Formula III:

(Formula III)

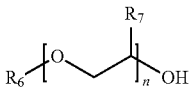

wherein $R_6$ is an aryl group or a linear, branched, or cyclic aliphatic group having 5 to 50 carbons, $R_7$ is a C1 to C4 alkyl group, and n is an integer from 5 to 100; and/or wherein the fuel additive package includes about 20 to about 60 weight percent of the Mannich detergent, about 1 to about 15 weight percent of the quaternary ammonium internal salt, and about 5 to about 30 weight percent of the alkoxylated alcohol; and/or further comprising a succinimide detergent prepared by reacting a hydrocarbyl-substituted succinic acylating agent with an amine, polyamine, or alkyl amine having one or more primary, secondary, or tertiary amino groups; and/or wherein the fuel additive package includes about 0.1 to about 10 weight percent of the succinimide detergent; and/or wherein the succinimide detergent is a hydrocarbyl substituted mono-succinimide detergent, a hydrocarbyl substituted bis-succinimide detergent, or a combination thereof, and/or further comprising one or more of a demulsifier, a corrosion inhibitor, an antiwear additive, an antioxidant, a metal deactivator, an antistatic additive, a dehazer, an antiknock additive, a lubricity additive, and/or a combustion improver.

In other approaches or embodiments, the disclosure herein also describes a gasoline fuel composition comprising about 40 to about 750 ppmw of a fuel additive package as described in any of the embodiments from the previous two paragraphs and including about 15 to about 300 ppmw of the Mannich detergent, about 0.1 to about 10 ppmw of the quaternary ammonium internal salt, and about 2 to about 90 ppmw of the alkoxylated alcohol.

The gasoline fuel composition of the previous paragraph may also include other optional features or embodiments in any combination. These optional feature or embodiments of the gasoline fuel composition may include one or more of the following: wherein intake valve deposits, as measured pursuant to one of ASTM D6201, or ASTM D5500 are reduced when the gasoline fuel composition is combusted in a spark-ignition engine as compared to combusting a gasoline fuel composition including the aminophenol detergent and/or the alkoxylated alcohol and being devoid of the quaternary ammonium internal salt; and/or wherein the spark-ignition engine is a gasoline direct or port fuel injection engine.

In yet other approaches or embodiments, a method of improving the injector performance of a gasoline direct injection (GDI) engine is described herein. The method includes operating the gasoline direct injection engine on a fuel composition containing a major amount of a gasoline fuel and a minor amount of the fuel additive package as described by any embodiment set forth in this Summary, and wherein the fuel additive package in the gasoline fuel improves the injector performance of the gasoline direct injection engine. Also provided herein is the use of a fuel additive package as described by any embodiment herein or any embodiment of a fuel composition herein for improving the injector performance of a gasoline direct injection engine.

The method or the use of the previous paragraph may include optional steps, features, or limitations in any combination thereof. Approaches or embodiments of the method or use may include one or more of the following: wherein the improved injector performance is one of improved fuel flow, improved fuel economy, improved engine efficiency, or combinations thereof; and/or wherein the improved injector performance is measured by one of injector pulse width, injection duration, injector flow, or combinations thereof.

BRIEF DESCRIPTION OF DRAWING FIGURES

DETAILED DESCRIPTION

Figure 1:
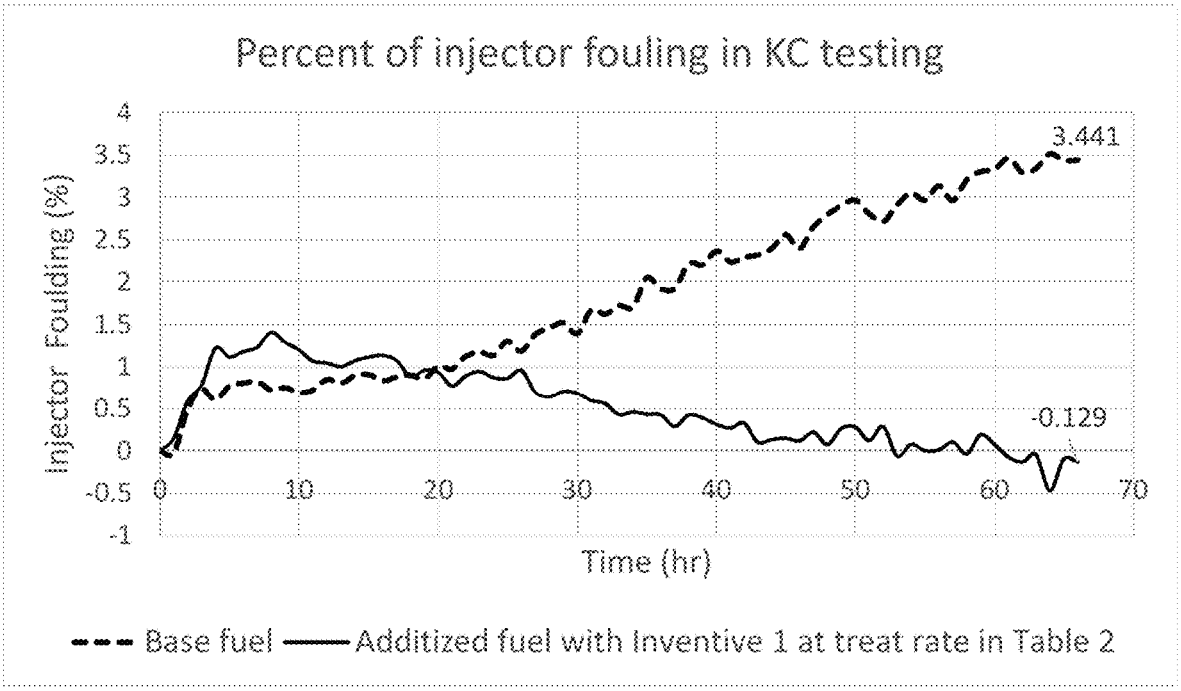
FIG. 1 is a graph showing percent of injector fouling in a base fuel and an additized fuel.

The present disclosure provides fuel additives including combinations of Mannich detergents and quaternary ammonium salts and, in particular, Mannich detergents and hydrocarbyl-substituted quaternary ammonium internal salts discovered effective to provide improved engine and/or injector performance in both port fuel injection (PFI) engines as well as gasoline direct injection (GDI) engines. The fuel additives, in some approaches, may also include alkoxylated alcohols and, when included, certain ratios of the alkoxylated alcohol to the Mannich detergent. Also provided herein are fuel compositions including the novel fuel additive combinations and methods of using or combusting a fuel including the fuel additive combinations herein to achieve the improved engine and/or injector performance.

In aspects or embodiments of this disclosure, improved engine and/or injector performance of the fuel additive combinations herein may include one or more of controlling or reducing fuel injector deposits, controlling or reducing intake valve deposits, controlling or reducing combustion chamber deposits and/or controlling or reducing intake valve sticking. Improved injector performance may also be one or more of improved fuel flow, improved fuel economy, and/or improved engine efficiency as determined via one or more of injector pulse width, injection duration, and/or injector flow.

Mannich Detergent

In one aspect, the fuel additives and fuels herein include a Mannich detergent. Suitable Mannich detergents include the reaction product(s) of an alkyl-substituted hydroxyaromatic or phenol compound, aldehyde, and amine as discussed more below.

In one approach, the alkyl substituents of the hydroxyaromatic compound may include long chain hydrocarbyl groups on a benzene ring of the hydroxyaromatic compound and may be derived from an olefin or polyolefin having a number average molecular weight (Mn) from about 500 to about 3000, preferably from about 700 to about 2100, as determined by gel permeation chromatography (GPC) using polystyrene as reference. The polyolefin, in some approaches, may also have a polydispersity (weight average molecular weight/number average molecular weight) of about 1 to about 10 (in other instances, about 1 to 4 or about 1 to about 2) as determined by GPC using polystyrene as reference.

The alkylation of the hydroxyaromatic or phenol compound is typically performed in the presence of an alkylating catalyst at a temperature in the range of about 0 to about 200° C., preferably 0 to 100° C. Acidic catalysts are generally used to promote Friedel-Crafts alkylation. Typical catalysts used in commercial production include sulphuric acid, $BF_3$, aluminum phenoxide, methanesulphonic acid, cationic exchange resin, acidic clays and modified zeolites.

Polyolefins suitable for forming the alkyl-substituted hydroxyaromatic compounds of the Mannich detergents include polypropylene, polybutenes, polyisobutylene, copolymers of butylene and/or butylene and propylene, copolymers of butylene and/or isobutylene and/or propylene, and one or more mono-olefinic comonomers copolymerizable therewith (e.g., ethylene, 1-pentene, 1-hexene, 1-octene, 1-decene, etc.) where a copolymer molecule contains at least 50% by weight, of butylene and/or isobutylene and/or propylene units. Any comonomers polymerized with propylene or butenes may be aliphatic and can also contain non-aliphatic groups, e.g., styrene, o-methylstyrene, p-methylstyrene, divinyl benzene and the like if needed. Thus, the resulting polymers and copolymers used in forming the alkyl-substituted hydroxyaromatic compounds are substantially aliphatic hydrocarbon polymers.

Polybutylene is preferred for forming the hydrocarbyl-substituted hydroxyaromatic or phenol compounds herein. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polyisobutenes having relatively high proportions of polymer molecules having a terminal vinylidene group are also suitable for use in forming the long chain alkylated phenol reactant. Suitable high-reactivity polyisobutenes include those polyisobutenes that comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808, which are both incorporated herein by reference.

The Mannich detergent, in some approaches or embodiments, may be made from an alkylphenol or alkylcresol. However, other phenolic compounds may be used including alkyl-substituted derivatives of resorcinol, hydroquinone, catechol, hydroxydiphenyl, benzylphenol, phenethylphenol, naphthol, tolylnaphthol, among others. Preferred for the preparation of the Mannich detergents are the polyalkylphenol and polyalkylcresol reactants, e.g., polypropyl phenol, polybutylphenol, polypropylcresol and polybutylcresol, wherein the alkyl group has a number average molecular weight of about 500 to about 3000 or about 500 to about 2100 as measured by GPC using polystyrene as reference, while the most preferred alkyl group is a polybutyl group derived from polyisobutylene having a number average molecular weight in the range of about 700 to about 1300 as measured by GPC using polystyrene as reference.

The preferred configuration of the alkyl-substituted hydroxyaromatic compound is that of a para-substituted mono-alkylphenol or a para-substituted mono-alkyl orthocresol. However, any hydroxyaromatic compound readily reactive in the Mannich condensation reaction may be employed. Thus, Mannich products made from hydroxyaromatic compounds having only one ring alkyl substituent, or two or more ring alkyl substituents are suitable for forming this detergent additive. The alkyl substituents may contain some residual unsaturation, but in general, are substantially saturated alkyl groups.

In approaches or embodiments, representative amine reactants suitable to form the Mannich detergent herein include, but are not limited to, alkylene polyamines having at least one suitably reactive primary or secondary amino group in the molecule. Other substituents such as hydroxyl, cyano, amido, etc., can be present in the polyamine. In a one embodiment, the alkylene polyamine is a polyethylene polyamine. Suitable alkylene polyamine reactants include ethylenediamine, diethylenetriamine, triethylenetetramine, tetraethylene pentamine and mixtures of such amines having nitrogen contents corresponding to alkylene polyamines of the formula $H_2N\text{-}(A\text{-}NH\text{—})_nH$, where A in this formula is divalent ethylene or propylene and n is an integer of from 1 to 10, preferably 1 to 4. The alkylene polyamines may be obtained by the reaction of ammonia and dihalo alkanes, such as dichloro alkanes.

The amine may also be an aliphatic diamine having one primary or secondary amino group and at least one tertiary amino group in the molecule. Examples of suitable polyamines include N,N,N",N"-tetraalkyldialkylenetriamines (two terminal tertiary amino groups and one central secondary amino group), N,N,N',N"-tetraalkyltrialkylene tetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), N,N'-dialkylamine, N,N-dihydroxyalkyl-alpha-, omega-alkylenediamines (one terminal tertiary amino group and one terminal primary amino group), N,N,N'-trihydroxyalkyl-alpha, omega-alkylenediamines (one terminal tertiary amino group and one terminal secondary amino group), tris(dialkylaminoalkyl) aminoalkylmethanes (three terminal tertiary amino groups and one terminal primary amino group), and similar compounds, wherein the alkyl groups are the same or different and typically contain no more than about 12 carbon atoms each, and which preferably contain from 1 to 4 carbon atoms each. Most preferably these alkyl groups are methyl and/or ethyl groups. Preferred polyamine reactants are N,N-dialkyl-alpha, omega-alkylene diamine, such as those having from 3 to about 6 carbon atoms in the alkylene group and from 1 to about 12 carbon atoms in each of the alkyl groups, which most preferably are the same but which can be different. Exemplary amines may include N,N-dimethyl-1,3-propanediamine and/or N-methyl piperazine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1,3-propanediamine, N-neopentyl-1,3-propane diamine-, N-(tert-butyl)-1-methyl-1,2-ethanediamine, N-(tert-butyl)-1-methyl-1,3-propane diamine, and 3,5-di (tert-butyl)aminoethylpiperazine.

In approaches or embodiments, representative aldehydes for use in the preparation of the Mannich detergents herein include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

The condensation reaction among the alkylphenol, the specified amine(s) and the aldehyde may be conducted at a temperature typically in the range of about 40° C. to about 200° C. The reaction can be conducted in bulk (no diluent or solvent) or in a solvent or diluent. Water is evolved and can be removed by azeotropic distillation during the course of the reaction. Typically, the Mannich reaction products are formed by reacting the alkyl-substituted hydroxyaromatic compound, the amine and aldehyde in the molar ratio of 1.0:0.5-2.0:1.0-3.0, respectively. Suitable Mannich base detergents include those detergents taught in U.S. Pat. Nos. 4,231,759; 5,514,190; 5,634,951; 5,697,988; 5,725,612; and 5,876,468, the disclosures of which are incorporated herein by reference.

In other approaches or embodiments, suitable Mannich detergents for the fuel additives herein may have a structure of Formula I below:

(Formula I)

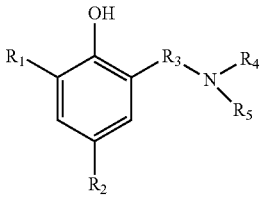

wherein $R_1$ is hydrogen or a C1 to C4 alkyl group, $R_2$ is a hydrocarbyl group having a number average molecular weight of about 500 to about 3000 (or about 500 to about 2100 or about 500 to about 1800), $R_3$ is a C1 to C4 alkylene or alkenyl linking group, and $R_4$ and $R_5$ are, independently, hydrogen, a C1 to C12 alkyl group, or a C1 to C4 alkyl amino C1-C12 alkyl group.

A fuel additive or additive package may include about 10 to about 70 weight percent of the above-described Mannich detergent, about 20 to about 60 weight percent of the Mannich detergent, or about 30 to about 50 weight percent of the Mannich detergent (based on the total weight of the active Mannich detergent in the fuel additive). When blended into a gasoline fuel, the fuel composition may include about 15 ppmw to about 300 ppmw of the above-described Mannich detergent, about 25 ppmw to about 155 ppmw, or about 55 ppmw to about 125 ppmw of the Mannich detergent in the fuel composition (active Mannich detergent treat rates).

Quaternary Ammonium Internal Salt:

In another aspect, the fuel additives or fuels herein include a quaternary ammonium salt and, preferably, a quaternary ammonium internal salt or betaine compound. In approaches or embodiments, the quaternary ammonium salt additive may be any hydrocarbyl substituted quaternary ammonium internal salt (or betaine) obtained from amines or polyamines that are substantially devoid of any free anion species. For example, such additive may be made by reacting a tertiary amine of the structure below

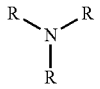

wherein each R group of the above structure is independently selected from hydrocarbyl groups containing from 1 to 200 carbon atoms with a halogen substituted C2-C8 carboxylic acid, ester, amide, or salt thereof. In approaches, what is generally to be avoided is quaternizing agents selected from the group consisting of hydrocarbyl substituted carboxylates, carbonates, cyclic-carbonates, phenates, epoxides, or mixtures thereof. In one embodiment, the halogen substituted C2-C8 carboxylic acid, ester, amide, or salt thereof may be selected from chloro-, bromo-, fluoro-, and iodo-C2-C8 carboxylic acids, esters, amides, and salts thereof. The salts may be alkali or alkaline earth metal salts selected from sodium, potassium, lithium calcium, and magnesium salts. A particularly useful halogen substituted compound for use in the reaction is the sodium or potassium salt of a chloroacetic acid.

As used herein the term "substantially devoid of free anion species" means that the anions, for the most part are covalently bound to the product such that the reaction product as made does not contain substantial amounts of free anions or anions that are ionically bound to the product. In one embodiment, "substantially devoid" means a range from 0 to less than about 2 weight percent of free anion species, less than about 1.5 weight percent, less than about 1 weight percent, less than about 0.5 weight percent, or none.

In another approach or embodiment, a tertiary amine including monoamines and polyamines may be reacted with the halogen substituted acetic acid, ester, or other derivative thereof to provide the quaternary ammonium internal salt additive herein. Suitable tertiary amine compounds are those of structure above wherein each of R group is independently selected, as noted above, from hydrocarbyl groups containing from 1 to 200 carbon atoms. Each hydrocarbyl group R may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amido groups, ester groups, imido groups, and the like. Any of the foregoing hydrocarbyl groups may also contain hetero atoms, such as oxygen or nitrogen atoms. Particularly suitable hydrocarbyl groups may be linear or branched alkyl groups. In some approaches, the tertiary amine may be the reaction product of a diamine or triamine with one tertiary amine and a hydrocarbyl substituted carboxylic acid. In other approaches, some representative examples of amine reactants which can be reacted to yield compounds of this disclosure include, but are not limited to, trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N,N-dimethylpropane diamine, N-methyl piperidine, N,N'-dimethyl piperazine, N-methyl-N-ethyl piperazine, N-methyl morpholine, N-ethyl morpholine, N-hydroxyethyl morpholine, pyridine, triethanol amine, triisopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethylene diamine, hexa-methylenetetramine, N,N,N',N'-tetramethylethylenediamine, N,N,N',N'-tetramethyl-propylenediamine, N,N,N',N'-tetraethyl-1,3-propanediamine, methyldi-cyclohexyl amine, 2,6-dimethylpyridine, dimethylcylohexylamine, C10-C30-alkyl or alkenyl-substituted amidopropyldimethylamine, C12-C200-alkyl or alkenyl-substituted succinic-carbonyl-dimethylamine, and the like. In one approach or embodiment, a suitable quaternary ammonium internal salt additive may be the internal salts of oleyl amidopropyl dimethylamino or oleyl dimethyl amine.

If the amine contains solely primary or secondary amino groups, it may be necessary to alkylate at least one of the primary or secondary amino groups to a tertiary amino group prior to the reaction with the halogen substituted C2-C8 carboxylic acid, ester, amide, or salt thereof. In one embodiment, alkylation of primary amines and secondary amines or mixtures with tertiary amines may be exhaustively or partially alkylated to a tertiary amine. It may also be necessary to properly account for the hydrogens on the nitrogen and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine for further reaction.

The halogen substituted C2-C8 carboxylic acid, ester, amide, or salt thereof for use in making the quaternary internal salt additive may be derived from a mono-, di-, or tri- chloro-, bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof. The salts of the carboxylic acids may include the alkali or alkaline earth metal salts, or ammonium salts including, but not limited to the Na, Li, K, Ca, Mg, triethyl ammonium and triethanol ammonium salts of the halogen-substituted carboxylic acids. A particularly suitable halogen substituted carboxylic acid, ester, or salt thereof may be selected from chloroacetic acid or esters thereof and sodium or potassium chloroacetate. The amount of halogen substituted C2-C8 carboxylic acid, ester, amide, or salt thereof relative to the amount of tertiary amine reactant may range from a molar ratio of about 1:0.1 to about 0.1:1.0.

In yet other approaches, internal salts of the mixtures herein may be made according to the foregoing procedures and may include, but are not limited to (1) hydrocarbyl substituted compounds of the formula R"—$NMe_2CH_2COO$ where R" is from C1 to C30 or a substituted amido group; (2) fatty amide substituted internal salts; and (3) hydrocarbyl substituted imide, amide, or ester internal salts wherein the hydrocarbyl group has 8 to 40 carbon atoms. Particularly suitable internal salts may be selected from the group consisting of polyisobutenyl substituted succinimide, succinic diamide, and succinic diester internal salts; C8-C40 alkenyl substituted succinimide, succinic diamide, and succinic diester internal salts; oleyl amidopropyl dimethylamino internal salts; and oleyl dimethylamino internal salts.

In yet another approach, the quaternary ammonium internal salt of the fuel additives and fuels herein is an internal salt or betaine compound having the structure of Formula II below:

(Formula II)

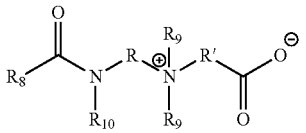

wherein R and R' of the structure above are independently alkylene linkers having 1 to 10 carbon atoms (in other approaches 1 to 3 carbon atoms); $R_8$ is a saturated alkylene, unsaturated alkene, or a linear, branched, or cyclic hydrocarbyl group or optionally a substituted or unsubstituted C12 to C100 hydrocarbyl group, or an aryl group or optionally substituted aryl group (in one approach, $R_8$ is a C8 to C20 hydrocarbyl group); each $R_9$ is independently a linear or branched C1 to C4 alkyl group; and $R_{10}$ is a hydrogen atom or a C1 to C4 alkyl group. The internal salts of Formula II may also be substantially devoid of free anion species as discussed above.

In another approach, the quaternary ammonium salt additive includes the compound of Formula II above wherein R is a propylene linker, R' is a methylene linker, $R_8$ is a C8 to C20 hydrocarbyl group, each $R_9$ is a methyl group, and $R_{10}$ is hydrogen. In yet other approaches, the quaternary ammonium salt internal salt is selected from oleyl amidopropyl dimethylamine internal salts or oleyl dimethylamino internal salts. In some approaches, such additive may be substantially devoid of free anion species as noted above.

An exemplary reaction scheme of preparing the quaternary ammonium internal salt is shown below in the exemplary process of Reaction Scheme I; of course, other methods of preparing the first quaternary ammonium salt additives described herein may also be utilized:

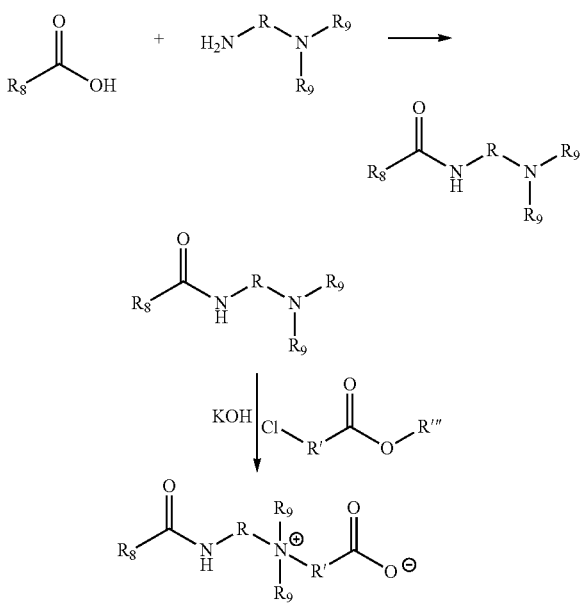

In the reaction scheme above, $R_8$ may be as described above or, in one approach, an alkyl group such as a C12 to C100 hydrocarbyl group; R and R' are independently alkyl ene linkers having 1 to 10 carbon atoms; each $R_9$ is independently a alkyl group or a linear or branched $C_1$ to $C_4$ group; and R'" is an alkyl group or hydrogen.

A fuel additive herein may include about 1 to about 15 weight percent of the quaternary ammonium internal salt, about 1 to about 10 weight percent of the quaternary ammonium internal salt, or about 1.5 to about 5 weight percent of the quaternary ammonium internal salt (based on the total active weight of the quaternary ammonium salt in the fuel additive). When blended into a gasoline fuel, the fuel may include about about 0.1 to about 20 ppmw of the active quaternary ammonium internal salt, about 0.1 to about 10 ppmw, about 0.3 ppmw to about 5 ppmw, or about 1 ppmw to about 3 ppmw of the active quaternary ammonium internal salt in the fuel.

Alkoxylated Alcohol

The fuel additives or fuels of the present disclosure may also include one or more optional alkoxylated alcohols. The alkoxylated alcohol is preferably a polyether prepared by reacting an long chain alkyl alcohol or alkylphenol with an alkylene oxide. By one approach, the alkoxylated alcohol may be one or more hydrocarbyl-terminated or hydrocarbyl-capped poly(oxyalkylene) polymers. The hydrocarbyl moieties thereof may be aryl or aliphatic groups, and preferably, aliphatic chains that are linear, branched or cyclic, and most preferably are linear aliphatic chains. In one approach, the alkoxylated alcohols may have the structure of Formula IIIa, IIIb, and/or IIIc below:

(Formula IIIa)

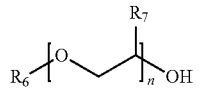

(Formula IIIb)

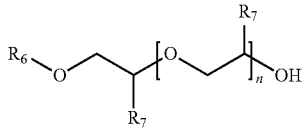

(Formula IIIc)

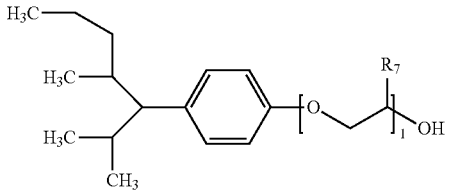

wherein $R_6$ is an aryl group or a linear, branched, or cyclic aliphatic group and preferably having 5 to 50 carbons (or 5 to 30 carbons) or may be a $—C_mH_{2m+1}$ group where m is an integer of 12 or more, $R_7$ is a C1 to C4 alkyl group, and n is an integer from 5 to 100 (or as further discussed below).

In some approaches, suitable alkoxylated alcohols are derived from lower alkylene oxides selected from the group consisting of ethylene oxide, propylene oxide, butylene oxide, copolymers thereof, and combinations thereof. Preferably, the lower alkylene oxides are propylene oxide or butylene oxide or copolymers of ethylene oxide, propylene oxide, and butylene oxide (as well as any combinations thereof). In another approach, the alkylene oxides are propylene oxide. Any copolymers of such alkylene oxides may be random or block copolymers. In one approach, the alkoxylated alcohols may be terminated or capped with an aryl, alkyl, or hydrocarbyl group and may include one or more aryl or linear, branched, or cyclic aliphatic C5 to C30 terminated alkoxylated alcohols, and in other approaches, a C16 to C18 (or blend thereof) terminated alkoxylated alcohol having 5 to 100, 10 to 80, 20 to 50, or 22 to 32 repeating units of the alkylene oxide therein (that is, n integer of the formula above). In some approaches, the alkoxylated alcohols may have a weight average molecular weight of about 1300 to about 2600 and, in other approaches, about 1600 to about 2200.

In some approaches, the aliphatic hydrocarbyl terminated alkoxylated alcohols may include about 20 to about 70 weight percent (in another approach, about 30 to about 50 weight percent) of an aliphatic C16 alkoxylated alcohol having 24 to 32 repeating units of alkoxylene oxide and/or may include about 80 to about 30 weight percent (in another approach, about 50 to about 70 weight percent) of an aliphatic C18 alkoxylated alcohol having 24 to 32 repeating units of alkoxylene oxide. In other approaches, the fuel additives herein, if including an alkoxylated alcohol, may also have about 8 percent or less (in other approaches, about 6 percent or less, and in yet other approaches, about 4 percent or less) of C20 or greater alkoxylated alcohols and/or about 4 weight percent or less (in or other approaches about 2 weight percent or less, and in yet other approaches, about 1 percent or less) of C14 or lower alkoxylated alcohols.

The aryl or hydrocarbyl-capped poly(oxyalkylene) alcohols may be produced by the addition of lower alkylene oxides, such as ethylene oxide, propylene oxide, or the butylene oxides, to a desired hydroxy compound R—OH (that is, a starter alcohol) under polymerization conditions, wherein R is the aryl or hydrocarbyl group having either 5 to 30 carbons or other chain length as noted above and which caps the poly(oxyalkylene) chain. The alkoxylated alcohols can be prepared by any starter alcohol that provides the desired polyol distribution. By one approach, the alkoxylated alcohol can be prepared by reacting a saturated linear or branched alcohol of the desired hydrocarbon size with the selected alkylene oxide and a double metal or basic catalyst. In one approach, the alkoxylated alcohol may be nonylphenol alkyxylated alcohol such as nonylphenol propoxylated alcohol.

In other approaches, in the polymerization reaction a single type of alkylene oxide may be employed, e.g., propylene oxide, in which case the product is a homopolymer, e.g., a poly(oxyalkylene) propanol. However, copolymers are equally satisfactory and random or block copolymers are readily prepared by contacting the hydroxyl-containing compound with a mixture of alkylene oxides, such as a mixture of ethylene, propylene, and/or butylene oxides. Random polymers are more easily prepared when the reactivities of the oxides are relatively equal. In certain cases, when ethylene oxides is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. In one example, a particular block copolymer may be represented by a polymer prepared by polymerizing propylene oxide on a suitable mono-hydroxy compound to form a poly(oxypropylene) alcohol and then polymerizing butylene oxide on the poly (oxyalkylene) alcohol.

A fuel additive or fuel herein, when included, may include about 5 to about 30 weight percent of the alkoxylated alcohol, about 8 to about 20 weight percent of the alkoxylated alcohol, or about 10 to about 15 weight percent of the alkoxylated alcohol (based on the active alkoxylated alcohol in the fuel additive). When blended into a gasoline fuel, the fuel may include about 2 ppmw to about 150 ppmw of the active alkoxylated alcohol, 5 to about 150 ppmw, about 8 ppmw to about 50 ppmw, or about 15 ppmw to about 40 ppmw of the alkoxylated alcohol in the fuel.

Succinimide Detergents

The fuel additives or fuels herein may also include one or more optional hydrocarbyl substituted dicarboxylic anhydride derivatives, and preferably one or more succinimide detergents. In one approach, this additive may be prepared by reacting a hydrocarbyl-substituted succinic acylating agent with an amine, polyamine, or alkyl amine having one or more primary, secondary, or tertiary amino groups. In some embodiments, the hydrocarbyl substituted dicarboxylic anhydride derivative includes hydrocarbyl succinimides, succinamides, succinimide-amides and succinimide-esters. These nitrogen-containing derivatives of hydrocarbyl succinic acylating agents may be prepared by reacting a hydrocarbyl-substituted succinic acylating agent with an amine, polyamine, or alkyl amine having one or more primary, secondary, or tertiary amino groups. The detergents may be mono-succinimides, bis-succinimides, or combinations thereof.

In some approaches or embodiments, the hydrocarbyl substituted dicarboxylic anhydride derivative may include a hydrocarbyl substituent having a number average molecular weight ranging from about 450 to about 3000 as measured by GPC using polystyrene as reference. The derivative may be selected from a diamide, acid/amide, acid/ester, diacid, amide/ester, diester, and imide. Such derivative may be made from reacting a hydrocarbyl substituted dicarboxylic anhydride with ammonia, a polyamine, or an alkyl amine having one or more primary, secondary, or tertiary amino groups. In some embodiments, the polyamine or alkyl amine may be tetraethylene pentamine (TEPA), triethylenetetramine (TETA), and the like amines. In other approaches, the polyamine or alkyl amine may have the formula $H_2N$—$((CHR_1—(CH_2)_q\ NH)_r$—H, wherein $R_1$ is hydrogen or an alkyl group having from 1 to 4 carbon atoms, q is an integer of from 1 to 4 and r is an integer of from 1 to 6, and mixtures thereof. In other approaches, a molar ratio of the hydrocarbyl substituted dicarboxylic anhydride reacted with the ammonia, polyamine, or alkyl amine may be from about 0.5:1 to about 2:1, in other approaches about 1:1 to about 2:1.

In other approaches, the hydrocarbyl substituted dicarboxylic anhydride may be a hydrocarbyl carbonyl compound of the Formula IV:

(Formula IV)

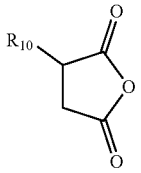

where $R_{10}$ is a hydrocarbyl group derived from a polyolefin. In some aspects, the hydrocarbyl carbonyl compound may be a polyalkylene succinic anhydride reactant wherein $R_{10}$ is a hydrocarbyl moiety, such as for example, a polyalkenyl radical having a number average molecular weight of from about 450 to about 3000 as measured by GPC using polystyrene as reference. For example, the number average molecular weight of $R_{10}$ may range from about 600 to about 2500, or from about 700 to about 1500, as measured by GPC using polystyrene as reference. A particularly useful $R_{10}$ has a number average molecular weight of about 950 to about 1000 Daltons (as measured by GPC using polystyrene as reference) and comprises polyisobutylene. Unless indicated otherwise, molecular weights in the present specification are number average molecular weights as measured by GPC using polystyrene as reference.

The $R_{10}$ hydrocarbyl moiety may include one or more polymer units chosen from linear or branched alkenyl units. In some aspects, the alkenyl units may have from about 2 to about 10 carbon atoms. For example, the polyalkenyl radical may comprise one or more linear or branched polymer units chosen from ethylene radicals, propylene radicals, butylene radicals, pentene radicals, hexene radicals, octene radicals and decene radicals. In some aspects, the $R_{10}$ polyalkenyl radical may be in the form of, for example, a homopolymer, copolymer or terpolymer. In one aspect, the polyalkenyl radical is isobutylene. For example, the polyalkenyl radical may be a homopolymer of polyisobutylene comprising from about 10 to about 60 isobutylene groups, such as from about 20 to about 30 isobutylene groups. The polyalkenyl compounds used to form the $R_{10}$ polyalkenyl radicals may be formed by any suitable methods, such as by conventional catalytic oligomerization of alkenes.

In some aspects, high reactivity polyisobutenes having relatively high proportions of polymer molecules with a terminal vinylidene group may be used to form the $R_{10}$ group. In one example, at least about 60%, such as about 70% to about 90%, of the polyisobutenes comprise terminal olefinic double bonds. High reactivity polyisobutenes are disclosed, for example, in U.S. Pat. No. 4,152,499, the disclosure of which is herein incorporated by reference in its entirety.

In some aspects, approximately one mole of maleic anhydride may be reacted per mole of polyalkylene, such that the resulting polyalkenyl succinic anhydride has about 0.8 to about 1 succinic anhydride group per polyalkylene substituent. In other aspects, the molar ratio of succinic anhydride groups to polyalkylene groups may range from about 0.5 to about 3.5, such as from about 1 to about 1.1.

The hydrocarbyl carbonyl compounds may be made using any suitable method. One example of a method for forming a hydrocarbyl carbonyl compound comprises blending a polyolefin and maleic anhydride. The polyolefin and maleic anhydride reactants are heated to temperatures of, for example, about 150° C. to about 250° C., optionally, with the use of a catalyst, such as chlorine or peroxide. Another exemplary method of making the polyalkylene succinic anhydrides is described in U.S. Pat. No. 4,234,435, which is incorporated herein by reference in its entirety.

In the hydrocarbyl substituted dicarboxylic anhydride derivative, the polyamine reactant may be an alkylene polyamine. For example, the polyamine may be selected from ethylene polyamine, propylene polyamine, butylenes polyamines, and the like. In one approach, the polyamine is an ethylene polyamine that may be selected from ethylene diamine, diethylene triamine, triethylene tetramine, tetraethylene pentamine, pentaethylene hexamine, and N,N'-(iminodi-2,1,ethanediyl) bis-1,3-propanediamine. A particularly useful ethylene polyamine is a compound of the formula $H_2N$—$((CHR_1—(CH_2)_q—NH)_r$—H, wherein $R_1$ is hydrogen, q is 1 and r is 4.

In yet further approaches, the hydrocarbyl substituted dicarboxylic anhydride derivative is a compound of Formula V (Formula V)

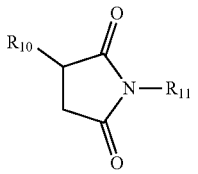

wherein $R_{10}$ is a hydrocarbyl group (such as polyisobutylene and/or the other above described $R_{10}$ moieties) and $R_{11}$ is a hydrogen, an alkyl group, an aryl group, —OH, —$NHR_{12}$, or a polyamine, or an alkyl group containing one or more primary, secondary, or tertiary amino groups. In some approaches, $R_{11}$ is derived from ethylene diamine, diethylene triamine, triethylene tetraamine, tetraethylene pentamine, pentaethylene hexamine, N,N'-(iminodi-2,1,ethanediyl) bis-1,3-propanediamine and combinations thereof. In some embodiments, $R_{10}$ is a hydrocarbyl group and $R_{11}$ is hydrogen, an alkyl group, an aryl group, —OH, —$NHR_{12}$, or a polyamine and wherein R12 is a hydrogen or an alkyl group. In other embodiments, the additive of Formula V includes a hydrocarbyl substituted succinimide derived from ethylene diamine, diethylene triamine, triethylene tetraamine, tetraethylene pentamine, pentaethylene hexamine, N,N'-(iminodi-2,1,ethanediyl)bis-1,3-propanediamine and combinations thereof. In still other embodiments, $R_4$ in the compound of Formula I is a hydrocarbyl group having a number average molecular weight from about 450 to about 3,000 and $R_{11}$ is derived from tetraethylene pentamine and derivatives thereof.

In yet other approaches $R_1$ is a compound of Formula VI $$-(CH_2)_m-A-)_n-(CH_2)_p-NR_{13}R_{14} \quad \text{(Formula VI)}$$

wherein A is $NR_{12}$ or an oxygen atom, $R_{12}$, $R_{13}$, and $R_{14}$ are independently a hydrogen atom or an alkyl group, m and p are integers from 2 to 8; and n is an integer from 0 to 4. In some approaches, $R_{13}$ and $R_{14}$ of Formula VI, together with the nitrogen atom to which they are attached, form a 5 membered ring. In approaches, the succinimide detergent is a hydrocarbyl substituted mono-succinimide detergent, a hydrocarbyl substituted bis-succinimide detergent, or a combination thereof.

A fuel additive or fuel herein, when included, may include about 0.1 to about 10 weight percent of the active succinimide detergent, about 0.5 to about 8 weight percent of the succinimide detergent, or about 1 to about 5 weight percent of the succinimide detergent (based on the total weight of the active succinimide within the fuel additive). When blended into a gasoline fuel, the fuel may include about 0.5 ppmw to about 20 ppmw of the active succinimide detergent, about 1 ppmw to about 10 ppmw, or about 2 ppmw to about 5 ppmw of the succinimide detergent in the fuel.

Fuel Additive:

When formulating the fuel compositions of this application, the above described additives (including at least the Mannich detergent and quaternary ammonium internal salt) may be employed in amounts sufficient to reduce or inhibit deposit formation in a fuel system, a combustion chamber of an engine and/or crankcase, and/or within fuel injectors and within a gasoline direction injection engine and/or a port fuel injection engine. Such additives may also be provided in amounts to improve injector performance as described herein. In some aspects, the fuel additive or fuel additive package herein may include at least the above described Mannich detergent, the quaternary ammonium internal salt, an optional alkoxylated alcohol, and an optional succinimide detergent. The fuel additives herein may also include other optional additives as needed for a particular application and may include as needed one or more of a demulsifier, a corrosion inhibitor, an antiwear additive, an antioxidant, a metal deactivator, an antistatic additive, a dehazer, an anti-knock additive, a lubricity additive, and/or a combustion improver.

In some approaches or embodiments, the fuel additive or additive package herein may include about 30 to about 60 weight percent of the Mannich detergent and about 1 to about 15 weight percent of the quaternary ammonium internal salt. In other approaches, the fuel additive or additive package may also include about 5 to about 20 weight percent of the alkoxylated alcohol and/or about 0.1 to about 10 weight percent of the Succinimide detergent.

In other approaches, a gasoline fuel composition may include about 40 to about 750 ppmw of the fuel additive or additive package herein, in other approaches, about 60 to about 380 ppmw, or about 135 to about 310 ppmw of the above noted fuel additive package and which provides about 15 to about 300 ppmw of the Mannich detergent and about 0.1 to about 10 ppmw of the quaternary ammonium internal salt to the fuel. In other embodiments, the fuel may also include about 2 to about 90 ppmw of the alkoxylated alcohol and/or about 0.5 to about 20 ppmw of the succinimide detergent. It will also be appreciated that any endpoint between the above described ranges are also suitable range amounts as needed for a particular application. The above-described amounts reflects additives on an active ingredient basis, which means the additives noted above excludes the weight of (i) unreacted components associated with and remaining in the product as produced and used, and (ii) solvent(s), if any, used in the manufacture of the product either during or after its formation.

In other approaches, the fuel additive package or fuel thereof also has a certain weight ratio of the alkoxylated alcohol to the Mannich detergent of about 0.8 or less (i.e., 0.8:1 or less), about 0.6 or less, about 0.5 or less, about 0.4 or less, or about 0.3 or less, and about 0.1 or more (i.e., 0.1:1), about 0.2 or more, or about 0.3 or more. In yet other approaches, the fuel additive package or fuel thereof may also have a weight ratio of the Mannich detergent to the quaternary ammonium internal salt of about 5:1 to about 100:1 or about 20:1 to about 80:1 or about 30:1 to about 75:1 (wherein the weight ratios are active Mannich detergent to the active quaternary ammonium internal salt).

Other Additives

One or more optional compounds may be present in the fuel compositions of the disclosed embodiments. For example, the fuels may contain conventional quantities of cetane improvers, octane improvers, corrosion inhibitors, cold flow improvers (CFPP additive), pour point depressants, solvents, demulsifiers, lubricity additives, friction modifiers, amine stabilizers, combustion improvers, detergents, dispersants, antioxidants, heat stabilizers, conductivity improvers, metal deactivators, marker dyes, organic nitrate ignition accelerators, cyclomatic manganese tricarbonyl compounds, carrier fluids, and the like. In some aspects, the compositions described herein may contain about 10 weight percent or less, or in other aspects, about 5 weight percent or less, based on the total weight of the additive concentrate, of one or more of the above optional additives. Similarly, the fuels may contain suitable amounts of conventional fuel blending components such as methanol, ethanol, dialkyl ethers, 2-ethylhexanol, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. Nos. 5,575,823 and 3,015,668 both of which disclosures are herein incorporated by reference in their entirety.

Other commercially available detergents may be used in combination with the reaction products described herein. Such detergents include but are not limited to succinimides, Mannich base detergents, PIB amine, quaternary ammonium detergents, bis-aminotriazole detergents as generally described in U.S. patent application Ser. No. 13/450,638, and a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697.

The additives of the present application and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

Fuels

The fuels of the present application may be applicable to the operation of diesel, jet, or gasoline engines, and preferably, spark-ignition or gasoline engines. The engines may include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, fatty acid alkyl ester, gas-to-liquid (GTL) fuels, gasoline, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. Preferably, the additives herein are used in spark-ignition fuels or gasoline. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol. Preferred fuels include diesel fuels.

Accordingly, aspects of the present application are directed to methods of or the use of the noted fuel additive package for controlling or reducing fuel injector deposits, controlling or reducing intake valve deposits, controlling or reducing combustion chamber deposits, and/or controlling or reducing intake valve sticking in one of port-injection engines, direct-injection engines, and preferably both engine types. In some aspects, the method may also comprise mixing into the fuel at least one of the optional additional ingredients described above. The improved engine performance may be evaluated pursuant to the test protocols of ASTM D6201 or by the methods as set forth in the following two SAE publications: Smith, S. and Imoehl, W., "Measurement and Control of Fuel Injector Deposits in Direct Injection Gasoline Vehicles," SAE Technical Paper 2013-01-2616, 2013, doi:10.4271/2013-01-2616 and/or Shanahan, C., Smith, S., and Sears, B., "A General Method for Fouling Injectors in Gasoline Direct Injection Vehicles and the Effects of Deposits on Vehicle Performance," SAE Int. J. Fuels Lubr. 10(3):2017, doi:10.4271/2017-01-2298, both of which are incorporated herein by reference. Intake valve sticking may be evaluated using the test protocols at Southwest Research Institute (SWRI, San Antonio Texas) or similar test house.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition. All percent numbers herein, unless specified otherwise, is weight percent.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mp of about 162 to about 14,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized IPLC grade tetrahydrofuran (THF) may be used as solvent, at a flow rate of 0.38 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THE and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

EXAMPLES

The following examples are illustrative of exemplary embodiments of the disclosure. In these examples as well as elsewhere in this application, all ratios, parts, and percentages are by weight unless otherwise indicated. It is intended that these examples are being presented for the purpose of illustration only and are not intended to limit the scope of the invention disclosed herein. The specifications for base fuels A, B, and C used in the Examples are shown below in Table 1.

TABLE 1

Fuel Specifications.

| FUEL PROPERTY | BASE FUEL A | BASE FUEL B | BASE FUEL C |
|---|---|---|---|
| API Gravity | 60.3 | 58.5 | 58.7 |
| Specific Gravity | 0.7377 | 0.7447 | 0.7440 |
| Density | 0.7370 | 0.7440 | 0.7432 |
| % Benzene | 0.47 | <0.10 | n.a. |
| Bromine No. | 9.7 | <0.5 | n.a. |
| BTU Gross (btu/lb) | 18711 | 19614 | 19674 |
| BTU Net (btu/lb) | 17477 | 18409 | 18465 |
| Unwashed Gum (ASTM D-381) | 3 | 3.5 | 1.5 |
| Washed Gum (ASTM D-381) | <0.5 | <0.5 | <0.5 |
| ASTM D-525 Oxidation (minutes) | 960 | 960+ | 960+ |
| RVP (ASTM D-5191) | 9.46 | 8.76 | 8.8 |
| %Carbon | 82.63 | 86.79 | n.a. |
| %Hydrogen | 13.53 | 13.21 | n.a. |
| Aromatics (vol-%) | 27.9 | 29.1 | 30.7 |
| Olefins (vol-%) | 4.7 | 1.2 | 9.2 |
| Saturates (vol-%) | 67.4 | 69.7 | 60.1 |
| Ethanol (vol-%) | 9.3 | <0.10 | n.a. |
| Oxygen Content | 3.84 | <0.02 | 0 |
| Sulfur (ppm) | 8.4 | 30 | 4.6 |
| RON | 98.2 | 97.4 | 91.4 |
| MON | 87.5 | 89 | 83.3 |
| Octane (R + M)/2 ASTM D-86 | 92.85 | 93.2 | 87.35 |

TABLE 1-continued

Fuel Specifications.

| FUEL PROPERTY | BASE FUEL A | BASE FUEL B | BASE FUEL C |
|---|---|---|---|
| (Temperature ° F.) | | | |
| Initial Boiling Point | 87 | 84.6 | 91.3 |
| 5% | 99.9 | 108 | 113.7 |
| 10% | 110.5 | 121.5 | 125 |
| 20% | 125.2 | 104.6 | 140.2 |
| 30% | 140.3 | 163 | 157.1 |
| 40% | 152.5 | 191.4 | 174.2 |
| 50% | 165.6 | 215.8 | 193.3 |
| 60% | 228.4 | 228.4 | 227.1 |
| 70% | 250.5 | 237.3 | 257.8 |
| 80% | 276 | 254 | 288.5 |
| 90% | 316 | 337.5 | 332.6 |
| 95% | 343.6 | 338.4 | 368.4 |
| End Point | 398.5 | 398.7 | 423.8 |
| % Recovery | 96.1 | 97.3 | 97.2 |
| Residue | 1.1 | 1.1 | 1.1 |
| Loss | 2.8 | 1.6 | 1.7 |

Example 1

An oleylamidopropyl dimethylammonium betaine quaternary ammonium internal salt can be made by the process described in U.S. Pat. No. 8,894,726 (Inventive Example 3), which is incorporated herein by reference.

Example 2

Inventive and comparative fuel additive packages of Table 2 below were prepared. The Mannich product was prepared from a high reactivity polyisobutylene cresol, dibutylamine, and formaldehyde according to a known method (see, e.g., U.S. Pat. No. 6,800,103, which is incorporated herein by reference); the quaternary ammonium internal salt was oleylamidopropyl dimethylammonium from Example 1; the propoxylated alcohol was a blend of commercially available C16-C18 propoxylated alcohols; and the succinimide detergent was a 950 number average molecular weight polyisobutenyl mono-succinimide derived from tetraethylene pentaamine (TEPA).

TABLE 2

| Ingredients | Inventive 1 ppmw | Inventive 2 ppmw |
|---|---|---|
| Mannich Detergent | 82.4 | 82.4 |
| Quaternary Ammonium Internal Salt | 2.0 | 2.0 |
| Propoxylated alcohol | 33.1 | 41.2 |
| Mono-Succinimide | 3.1 | 3.1 |
| Propoxylated alcohol to Mannich detergent weight ratio | 0.40:1 | 0.50:1 |
| Mannich detergent to Quaternary ammonium salt weight ratio | 41.2:1 | 41.2:1 |

*The additive package also contained other non-detergent ingredients, such as demulsifier and solvent.

The additive packages of Table 2 were blended into Base Fuel A at the treat rates set forth in Table 3 below. The fuel was then evaluated for intake valve deposits and improvements from the base fuel without the additive determined pursuant to ASTM D6201.

TABLE 3

| IVD testing | Base Fuel | Inventive 1 | Inventive 2 |
|---|---|---|---|
| ASTM D6201, IVD, mg | 1263.1 | 62.7 | 53.9 |
| improvement from Base Fuel A IVD, % | — | 95.0 | 95.7 |

As shown in Table 3 above, the inventive samples exhibited goo IVD results.

Example 3

The fuel additives of Example 2 where further evaluated in an additive package of Table 4 below. The additives were the same as Example 2 except Inventive 4 included a bis-succinimide instead of a mono-succinimide as noted in Table 4.

TABLE 4

| Ingredients | Comparative 1 ppmw | Inventive 3 ppmw | Inventive 4 ppmw |
|---|---|---|---|
| Mannich Detergent | 164.1 | 164 | 164 |
| Quaternary Ammonium Internal Salt | | 2.3 | 2.3 |
| Propoxylated alcohol | 49.2 | 49.2 | 49.2 |
| Mono-Succinimide | 5.6 | 5.6 | |
| Bis-Succinimide | | | 7.1 |
| Propoxylated alcohol to Mannich detergent weight ratio | 0.30/1 | 0.30/1 | 0.30/1 |
| Mannich detergent to Quaternary ammonium salt weight ratio | — | 71.3:1 | 71.3:1 |

*The additive package also contained other non-detergent ingredients, such as demulsifier and solvent.

A series of tests were run to evaluate the impact that the additive packages have on fuel inject deposits in a gasoline direct injection engine (GDI). All tests were run with a consistent Base Fuel B during a Dirty-up (DU), Clean-up (CU) and/or Keep Clean (KC) phases of the respective test. The additive packages of Table 4 above were tested to evaluate the ability of each fuel additive to improve injector performance by reducing injector deposits in the GDI engine.

Each base fuel was investigated for a DU level by indirect measurements of injector fouling, such as by pulse width or long term fuel trim (LTFT), on a gasoline direct injection GM LHU engine pursuant to the RIFT methods as set forth in Smith, S. and Imoehl, W., "Measurement and Control of Fuel Injector Deposits in Direct Injection Gasoline Vehicles," SAE Technical Paper 2013-01-2616, 2013, doi: 10.4271/2013-01-2616 and/or Shanahan, C., Smith, S., and/or Sears, B., "A General Method for Fouling Injectors in Gasoline Direct Injection Vehicles and the Effects of Deposits on Vehicle Performance," SAE Int. J. Fuels Lubr. 10(3): 2017, doi:10.4271/2017-01-2298, both of which are incorporated by reference herein.

In order to accelerate the DU phase of the Base Fuel, a combination of di-tert-butyl disulfide (DTBDS 406.1 ppmw) and tert-butyl hydrogen peroxide (TBHP, 286 ppmw) were added to the base fuel and the DU was accelerated to provide the fouling in the range of 5-12%. Percent of fouling is calculated as:

$$\text{Percent of fouling} = \frac{\text{Injector pulse width} - \text{injector pulse width at start of testing}}{\text{injector pulse at start of testing}} * 100\%$$

GDI CU deposit tests were conducted to demonstrate the removal of deposits that had been formed in the fuel injectors during the dirty-up (DU) phase. The Additive packages of Table 4 were blended into the Base Fuel B that was used for DU. The test procedure consists of a 114 hour cycle at 2000 rpm and 100 Nm torque with continuous monitoring of injection pulse width to maintain stoichiometric Air/Fuel ratio on the GM LHU engine. After 66 hours of test operation, the fuel was changed to an additized formulation that is designed to have a clean-up effect. The percentage of injector pulse width increase, and subsequent decrease, after completion of the 114 hour cycle is one parameter for evaluating the fouling or cleaning effect of the fuel candidate at the treat rates set forth in Table 5 below, which demonstrated a clean-up (CU) of over 100% within 48 hours. CU is calculated as in the following equation:

$$CU = \frac{\text{Injector pulse width at end of DU} - \text{injector pulse width at end of testing}}{\text{Injector pulse width at end of DU} - \text{injector pulse width at starting of testing}} * 100\%$$

TABLE 5

| | Comparative 1 | Inventive 3 | Inventive 4 |
|---|---|---|---|
| Mannich, ppmw | 164.1 | 164.0 | 164.0 |
| Quaternary ammonium salt, ppmw | 0 | 2.3 | 2.3 |
| GDI CU by RIFT method, % | 79.9 | 100.09 | 101.9 |

Figure 2:
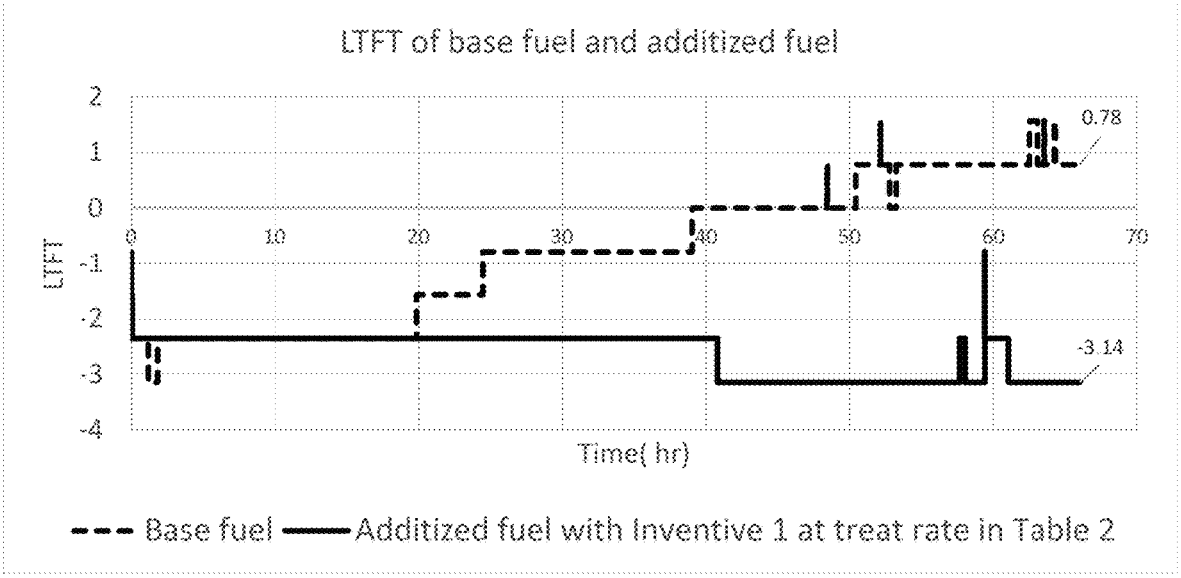
FIG. 2 is a graph showing Long Term Fuel Trim (LTFT) of a base fuel and an additized fuel.

As shown in Table 5 above, the inventive examples exhibited improved injector clean-up relative to the comparative example. Furthermore, GDI keep-clean (KC) was demonstrated by using the additive package of Table 1 in the base fuel at a certain treat rate on a GM LHU engine. The duration of the KC phase was 66 hours. In the KC phase, it can be seen that the additive package of Inventive 1 prevented deposits from being formed in the fuel as shown in FIG. 1. Once the additive is added, the LTFT decreased from about 0.78% to about −3.14% as shown in FIG. 2.

GDI CU deposit tests in Table 6 were carried out on a 2008 Pontiac Solstice vehicle. The additive packages were blended into Base Fuel C. The DU procedure was running by RTFT method described previously between 2000-3000 miles to achieve delta LTFT (Δ=end of DU-beginning of DU) of about 6.0% or above. At the end of DU, the fuel was changed to an additized formulation that is designed to have a clean-up effect

TABLE 6

| Composition | Inventive 5 ppmw | Comparative 2 ppmw | Comparative 3 ppmw |
|---|---|---|---|
| Mannich Detergent | 79.6 | 0 | 79.6 |
| Quaternary | 2.9 | 2.9 | 0 |

TABLE 6-continued

| Composition | Inventive 5 ppmw | Comparative 2 ppmw | Comparative 3 ppmw |
|---|---|---|---|
| Ammonium Internal Salt | | | |
| Propoxylated alcohol | 23.9 | 23.9 | 23.9 |
| LTFT in the beginning of DU, % | −3.1 | -3.9 | -5.5 |
| LTFT at the end of DU, % | 4.7 | 6.3 | 5.5 |
| LTFT at the end of CU, % | 0.8 | 7.8 | 3.9 |
| GDI CU, % | 50.0 | −14.7 | 14.5 |

Figure 3:
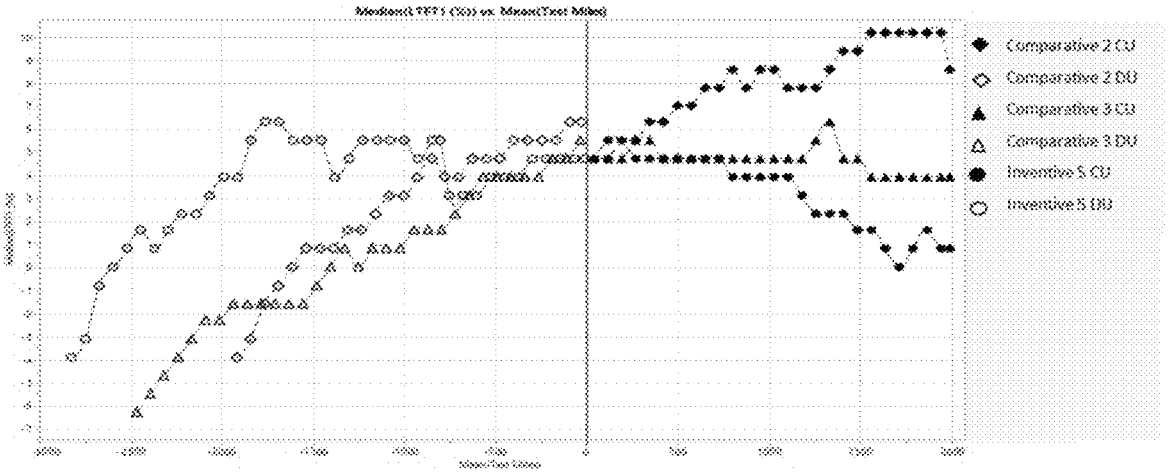
FIG. 3 is a graph showing Long Term Fuel Trim (LTFT) of Inventive 5 and Comparatives 3 and 4.

With combination of Mannich and Quaternary ammonium salt, the CU % is 50% while Mannich alone provided 14.5% GDI CU and quaternary ammonium salt −14.7% (continuing DU) as shown in FIG. 3.

$$CU\ \% = \frac{-(LTFT \text{ at end of } CU - LTFT \text{ at end of } DU) \times 100\%}{(LTFT \text{ at end of } DU - LTFT \text{ in the begining of } DU)}$$

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A fuel additive package for a spark-ignition engine comprising:

a Mannich detergent including the reaction product of a hydrocarbyl-substituted phenol, one or more aldehydes, and one or more amines, wherein the Mannich detergent has the structure of Formula I:

(Formula I)

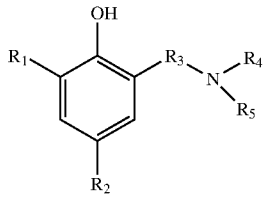

wherein $R_1$ is hydrogen or a C1 to C4 alkyl group, $R_2$ is a hydrocarbyl group having a number average molecular weight of about 500 to about 3000, $R_3$ is a C1 to C4 alkylene or alkenyl group, and $R_4$ and $R_5$ are, independently, hydrogen, a C1 to C12 alkyl group, or a C1 to C4 alkyl amino C1-C12 alkyl group;

a quaternary ammonium internal salt obtained from amines or polyamines that is substantially devoid of any free anion species, wherein the quaternary ammonium internal salt has the structure of Formula II (Formula II)

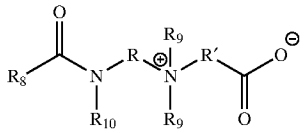

wherein R and R' are, independently, alkylene linkers having 1 to 10 carbon atoms; $R_8$ is a C12 to C100 alkylene, alkene, or hydrocarbyl group or an aryl group or optionally substituted aryl group; each $R_9$ is, independently, a linear or branched C1 to C4 alkyl group; and $R_{10}$ is a hydrogen atom or a C1 to C4 alkyl group;

an alkoxylated alcohol, wherein the alkoxylated alcohol is a polyether having the structure of Formula III:

(Formula III)

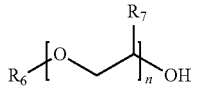

wherein $R_6$ is an aryl group or a linear, branched, or cyclic aliphatic group having 5 to 50 carbons, $R_7$ is a C1 to C4 alkyl group, and n is an integer from 5 to 100;

wherein a weight ratio of the alkoxylated alcohol to the Mannich detergent is about 0.8 or less;

wherein the fuel additive package includes about 20 to about 60 weight percent of the Mannich detergent and about 5 to about 30 weight percent of the alkoxylated alcohol; and wherein a weight ratio of the Mannich detergent to the quaternary ammonium internal salt is about 5:1 to about 100:1.

2. The fuel additive package of claim 1, wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof.

3. The fuel additive package of claim 1, wherein a weight ratio of the Mannich detergent to the quaternary ammonium internal salt is about 20:1 to about 80:1.

4. The fuel additive package of claim 1, wherein the fuel additive package includes about 1 to about 15 weight percent of the quaternary ammonium internal salt.

5. The fuel additive package of claim 1, further comprising a succinimide detergent prepared by reacting a hydrocarbyl-substituted succinic acylating agent with an amine, polyamine, or alkyl amine having one or more primary, secondary, or tertiary amino groups.

6. The fuel additive package of claim 4, wherein the fuel additive package includes about 0.1 to about 10 weight percent of the succinimide detergent.

7. The fuel additive package of claim 6, wherein the succinimide detergent is a hydrocarbyl substituted monosuccinimide detergent, a hydrocarbyl substituted bis-succinimide detergent, or a combination thereof.

8. The fuel additive package of claim 6, further comprising one or more of a demulsifier, a corrosion inhibitor, an antiwear additive, an antioxidant, a metal deactivator, an antistatic additive, a dehazer, an antiknock additive, a lubricity additive, and/or a combustion improver.

9. A gasoline fuel composition comprising:

about 55 to about 190 ppmw of a Mannich detergent including the reaction product of a hydrocarbyl-substituted phenol, one or more aldehydes, and one or more amines, wherein the Mannich detergent has the structure of Formula I:

(Formula I)

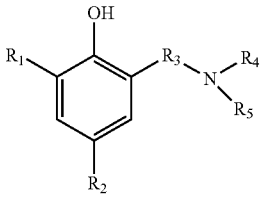

wherein $R_1$ is hydrogen or a C1 to C4 alkyl group, $R_2$ is a hydrocarbyl group having a number average molecular weight of about 500 to about 3000, $R_3$ is a C1 to C4 alkylene or alkenyl group, and $R_4$ and $R_5$ are, independently, hydrogen, a C1 to C12 alkyl group, or a C1 to C4 alkyl amino C1-C12 alkyl group;

about 0.1 to about 3 ppmw of a quaternary ammonium internal salt obtained from amines or polyamines that is substantially devoid of any free anion species, wherein the quaternary ammonium internal salt has the structure of Formula II (Formula II)

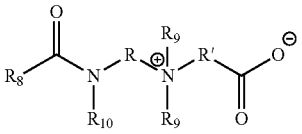

wherein R and R' are, independently, alkylene linkers having 1 to 10 carbon atoms; $R_8$ is a C12 to C100 alkylene, alkene, or hydrocarbyl group or an aryl group or optionally substituted aryl group; each $R_9$ is, independently, a linear or branched C1 to C4 alkyl group; and $R_{10}$ is a hydrogen atom or a C1 to C4 alkyl group;

about 15 to about 50 ppmw of an alkoxylated alcohol, wherein the alkoxylated alcohol is a polyether having the structure of Formula III:

(Formula III)

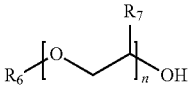

wherein $R_6$ is an aryl group or a linear, branched, or cyclic aliphatic group having 5 to 50 carbons, $R_7$ is a C1 to C4 alkyl group, and n is an integer from 5 to 100;

wherein a weight ratio of the alkoxylated alcohol to the Mannich detergent is about 0.8 or less; and wherein a weight ratio of the Mannich detergent to the quaternary ammonium internal salt is about 5:1 to about 100:1.

10. A method of improving the injector performance of a gasoline direct injection (GDI) engine, the method comprising:

operating the gasoline direct injection engine on a fuel composition containing a major amount of a gasoline fuel and a minor amount of the fuel additive package of claim 1; and wherein the fuel additive package in the gasoline fuel improves the injector performance of the gasoline direct injection engine.

11. The method of claim 10, wherein the improved injector performance is one of improved fuel flow, improved fuel economy, improved engine efficiency, or combinations thereof.

12. The method of claim 11, wherein the improved injector performance is measured by one of injector pulse width, injection duration, injector flow, or combinations thereof.

13. The fuel additive package of claim 1, wherein the weight ratio of the alkoxylated alcohol to the Mannich detergent is about 0.5 or less.

14. The gasoline fuel composition of claim 9, wherein the weight ratio of the alkoxylated alcohol to the Mannich detergent is about 0.5 or less.

15. The method of claim 10, wherein the weight ratio of the alkoxylated alcohol to the Mannich detergent is about 0.5 or less.

* * * * *